US005558432A

United States Patent [19]

Swisher, Jr.

[11] Patent Number: 5,558,432

[45] Date of Patent: Sep. 24, 1996

[54] DRUM MIXER HAVING A COMBINED HEATING/MIXING ZONE WITH AGGREGATE ENTRY AT BOTH ENDS

[76] Inventor: George W. Swisher, Jr., 1500 Dorchester Dr., Oklahoma City, Okla. 73120

[21] Appl. No.: 260,128

[22] Filed: Jun. 14, 1994

[51] Int. Cl.[6] ..... B28C 5/46

[52] U.S. Cl. ..... 366/25; 366/147; 432/109

[58] Field of Search ..... 366/25, 24, 23, 366/22, 4, 7, 144, 145, 147, 149; 432/109, 111, 14, 19; 106/274, 281.1, 284

[56] References Cited

U.S. PATENT DOCUMENTS

| | | | |
|---|---|---|---|
| 3,713,633 | 1/1973 | Falk | 432/109 |
| 3,840,215 | 10/1974 | McConnaughay | 259/158 |
| 3,866,888 | 2/1975 | Dydzyk | 259/158 |
| 4,147,436 | 4/1979 | Garbelman et al. | 366/25 |
| 4,298,287 | 11/1981 | McCarter, III et al. | 366/4 |
| 4,332,478 | 6/1982 | Binz | 366/4 |
| 4,361,406 | 11/1982 | Loggins, Jr. et al. | 366/25 |
| 4,481,039 | 11/1984 | Mendenhall | 106/281 R |
| 4,787,938 | 11/1988 | Hawkins | 106/281.1 |
| 4,797,002 | 1/1989 | Heap | 366/25 |
| 4,813,784 | 3/1989 | Musil | 366/24 |
| 4,919,538 | 4/1990 | Swisher, Jr. | 366/4 |
| 4,946,283 | 8/1990 | Musil | 366/15 |
| 4,989,986 | 2/1991 | Swisher | 432/111 |
| 5,033,863 | 7/1991 | Linkletter | 366/228 |
| 5,054,931 | 10/1991 | Farnham | 366/25 |

*Primary Examiner*—Robert W. Jenkins

*Attorney, Agent, or Firm*—Dunlap & Codding, P.C.

[57] ABSTRACT

A drum mixer having a combined heating-mixing zone which receives aggregate from both ends. The drum mixer includes a rotatable drum having an inlet end and a discharge end. Within the drum, a drying zone extends from the inlet end to a combustion zone and a mixing zone extends from the combustion zone to the discharge end. A cylindrical, tubular combustion housing is mounted in the combustion zone to define the heating-mixing zone between the drum and the combustion housing. The inner periphery of the combustion housing defines a combustion chamber into which the flame of a burner assembly is directed. The heating-mixing zone communicates with the drying zone, the combustion chamber, and the mixing zone. Aggregate is introduced into the drying zone and is urged toward the combustion zone as the drum is rotated. Upon reaching the combustion zone, a first portion of the aggregate enters the heating-mixing zone without entering the combustion chamber and a second portion of the aggregate travels through the combustion chamber before entering the heating-mixing zone. A recycle feed chute is provided to introduce recycle material into the heating-mixing zone. The aggregate-recycle mixture is then urged from the heating-mixing zone into the mixing zone, where liquid asphalt is added to produce an asphaltic composition.

14 Claims, 4 Drawing Sheets

DRUM MIXER HAVING A COMBINED HEATING/MIXING ZONE WITH AGGREGATE ENTRY AT BOTH ENDS

BACKGROUND OF THE INVENTION

1. Field of the Invention

The present invention relates generally to a drum mixer and, more particularly, but not by way of limitation, to an asphalt drum mixer which has a combined heating and mixing zone for receiving virgin aggregate and recycle aggregate in the preparation of hot mix asphalt.

2. Description of Related Art

U.S. Pat. No. 4,919,538 discloses a counterflow drum mixer having a combined mixing and heating zone. In this type of drum, virgin aggregate is introduced into a drying zone at one end of the drum and is urged through the drum to a mixing zone at the opposite end of the drum. Between the drying zone and the mixing zone is a combustion zone, which includes a burner flame for drying and heating aggregate.

Virgin aggregate is introduced into the drying zone and is urged toward the mixing zone as the drum mixer is rotated. The burner flame produces a hot gas stream which flows toward the drying zone, or counter to the movement of the virgin aggregate.

Within the combustion zone, a combustion housing shrouds the burner flame. An annulus is defined between the drum wall and the combustion housing. In this particular drum mixer, the combustion housing is a series of concentric cylindrical shells having diameters which become successively smaller from the entry end to the exit end of the combustion zone.

Recycle asphalt pavement is introduced into the annulus at the entry end of the combustion zone and hot, dry virgin aggregate is urged into the annulus from the drying zone. Then the virgin aggregate and the recycle asphalt pavement are heated and mixed in the annulus before being transferred into the mixing zone.

One object of asphalt drum mixers is to provide enough heat transfer to the virgin aggregate to remove moisture from the virgin aggregate in an efficient manner. Another object is to introduce the recycle asphalt pavement into the drum mixer at a point where it is not subjected to so much heat that smoke is produced.

SUMMARY OF THE INVENTION

The present invention is a drum mixer having a combined heating/mixing zone which receives hot, dry virgin aggregate at both ends. The drum mixer includes a rotatable drum having a drying zone, a combustion zone and a mixing zone.

A burner flame is located in the combustion zone and produces a hot gas stream which flows toward the drying zone. A combustion housing defines a combustion chamber into which the burner flame is directed.

A heating/mixing zone is defined between the drum wall and the combustion housing. At the entry end of the combustion housing, the drying zone communicates with the heating/mixing zone such that a first portion of hot, dry virgin aggregate enters the heating/mixing zone directly from the drying zone. A second portion of hot, dry virgin aggregate travels from the drying zone into the combustion chamber.

At the exit end of the combustion housing, the combustion chamber communicates with the heating/mixing zone such that hot, dry virgin aggregate in the combustion chamber is urged into the heating/mixing zone. Thus, the heating/mixing zone receives hot, dry aggregate at both ends.

A recycle feed chute communicates with the heating/mixing zone for introducing recycle asphalt pavement or other material into the heating/mixing zone. Recycle asphalt material and virgin aggregate are combined in the heating/mixing zone and then urged into the mixing zone.

A liquid asphalt tube extends into the drum for introducing liquid asphalt into the mixing zone, where the mixture of recycle asphalt pavement and virgin aggregate are mixed with liquid asphalt to produce hot mix asphalt product. The drum has a discharge chute for removal of the hot mix asphalt product from the mixing zone of the drum mixer.

One object of the present invention is to provide an asphalt drum mixer with improved heat transfer for better removal of moisture from virgin aggregate and recycle asphalt pavement.

Another object of the present invention is to provide an asphalt drum mixer with a high volume combustion chamber in order to prevent excessive heat in the combustion chamber.

Yet another object of the present invention is to provide an asphalt drum mixer with improved mixing of virgin aggregate with recycle asphalt pavement.

Still another object of the present invention is to provide an asphalt drum mixer which keeps liquid asphalt and recycle asphalt pavement from being subjected to temperatures high enough to produce smoke.

Other objects, features and advantages of the present invention are apparent from the following detailed description when read in conjunction with the accompanying drawings and appended claims.

BRIEF DESCRIPTION OF THE INVENTION

DETAILED DESCRIPTION OF THE PREFERRED EMBODIMENTS

Figure 1:
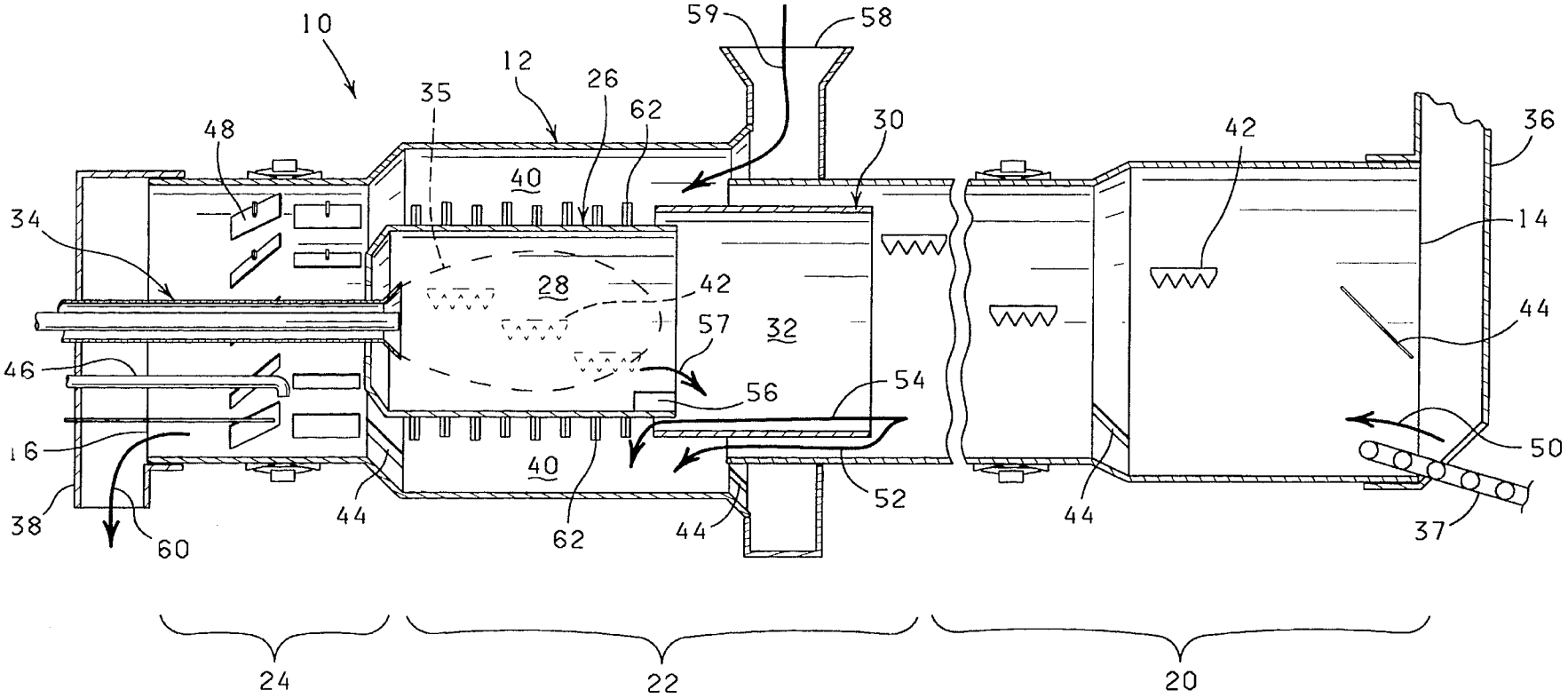
FIG. 1 PRIOR ART
FIG. 1 is a partly diagrammatical, partly sectional view of a prior art drum mixer.

Referring to the drawings in general, and to FIG. 1 in particular, shown therein and designated by the general reference numeral 10 is a prior art drum mixer, which includes a rotatable drum 12 having an inlet end 14, a discharge end 16 and an internal passageway between the inlet end 14 and the discharge end 16.

The internal passageway through the drum 12 is divided into a drying zone 20, a combustion zone 22 and a mixing zone 24. A combustion housing 26, which defines a combustion chamber 28, and a heating housing 30, which defines a heating chamber 32, are mounted within the combustion zone 22.

A burner assembly 34 extends into the drum 12 to position a flame 35 within the combustion chamber 28. The flame 35 produces a stream of hot gases flowing toward the drying zone 20. An exhaust duct 36 at the inlet end 14 of the drum 12 is connected to a conventional exhaust system (not shown) to draw gases through the drum 12.

A conveyor 37 is located at the inlet end 14 of the drum 12 for introducing aggregate into the drying zone 20. A discharge housing 38 at the discharge end 16 of the drum 12 receives asphalt product from the mixing zone 24 of the drum 12.

The combustion housing 26, the heating housing 30 and the interior wall of the drum 12 define a combined mixing/heating zone 40. A plurality of sawtooth veiling flights, such as the ones designated by reference numeral 42, extend from the interior wall of the drum 12 to mix and heat material in the drying zone 20 and in the combined mixing/heating zone 40. One end of the heating chamber 32 communicates with the combined mixing/heating zone 40 and the other end of the heating chamber 32 communicates with the drying zone 20.

Sets of lifting flights, generally designated by reference numeral 44, protrude from the interior wall of the drum 12 at various points to lift material and to urge material onward through the drum 12.

A liquid asphalt injection tube 46 extends into the drum mixer 10 for introducing liquid asphalt into the mixing zone 24. A plurality of mixing flights 48 extend from the interior wall of the drum 12 in the mixing zone 24. As the drum 12 is rotated, the mixing flights 48 combine liquid asphalt, recycle material and aggregate material to produce hot mix asphalt.

In operation, virgin aggregate is introduced into the drying zone 20 (direction arrow 50) and is urged toward the combustion zone 22 as the drum 12 is rotated. Upon reaching the heating chamber 32, a portion of the aggregate travels between the outside of the heating housing 30 and the interior wall of the drum 12 into the combined mixing/heating zone 40 (direction arrow 52). Another portion of the aggregate passes through the heating chamber 32 and then into the combined mixing/heating zone 40 (direction arrow 54).

In the drum mixer 10, it is an object to keep aggregate from entering the combustion chamber 28. A plurality of kicker plates, such as the one designated by reference numeral 56, protrude from the interior wall of the combustion housing 26 to kick out aggregate which may enter the combustion chamber 28 (direction arrow 57).

Recycle asphalt pavement or other suitable recycle material may be introduced into the combined mixing/heating zone 40 through a recycle feed hopper 58 (direction arrow 59). The recycle material and the aggregate are heated and mixed in the combined mixing/heating zone 40.

Eventually, the combined recycle material and aggregate mixture reaches into the mixing zone 24, where liquid asphalt is added to the mixture to produce hot mix asphalt product. As indicated by direction arrow 60, the asphalt product is discharged from the mixing zone 24 of the drum mixer 10.

One problem with the drum mixer 10 was excessive heat in the combustion chamber 28. Even with the addition of heat transfer fins (such as the ones designated by reference numeral 62) to the exterior wall of the combustion housing 26, the heat in the combustion chamber 28 was too great. In order to correct this problem, the diameter and volume of the combustion chamber had to be increased.

Figure 2:
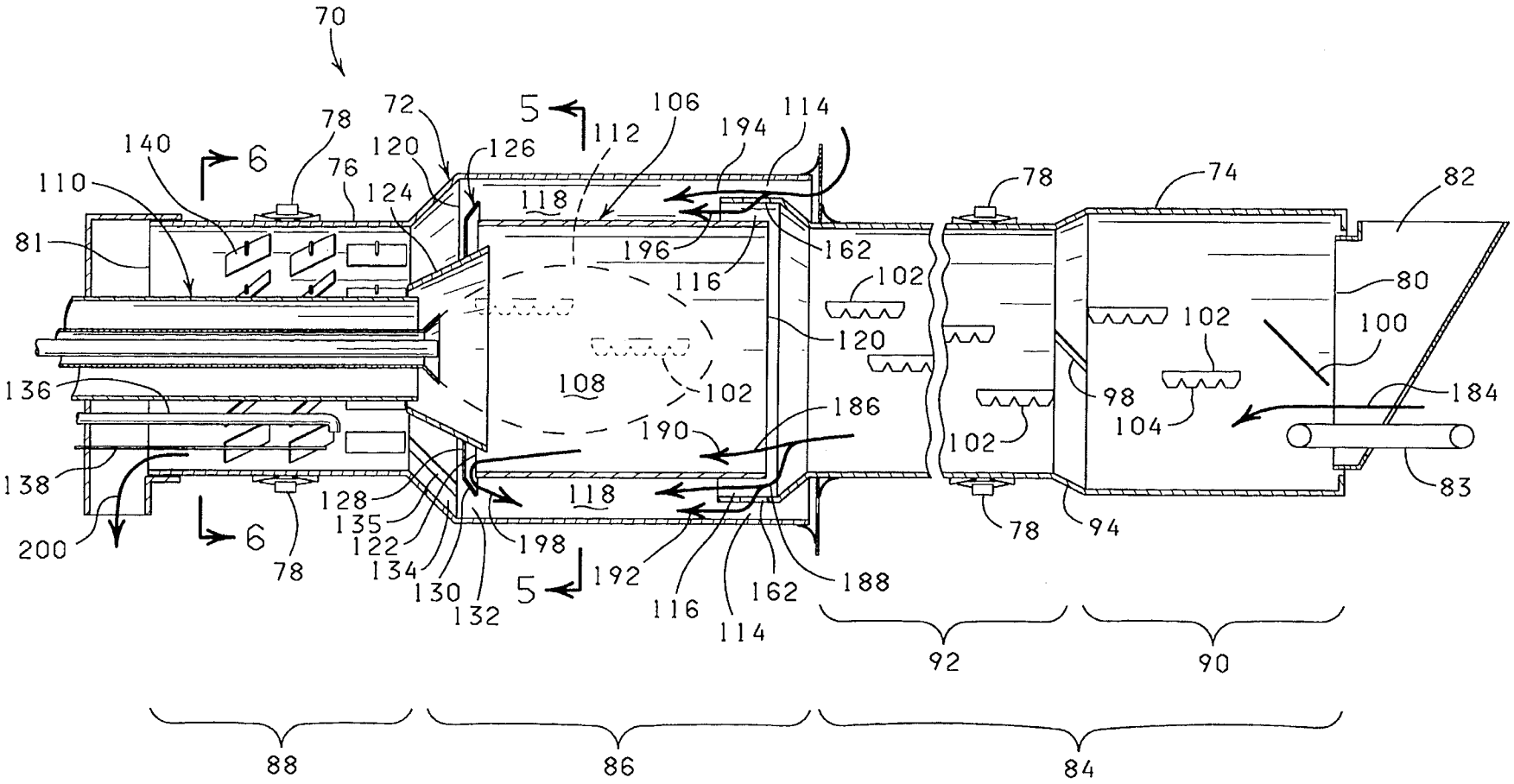
FIG. 2 is a partly diagrammatical, partly sectional view of a drum mixer constructed in accordance with the present invention.

With reference now to FIG. 2, shown therein and designated by reference number 70 is a drum mixer constructed in accordance with the present invention and having a high volume combustion chamber. The drum mixer 70 comprises a rotatable drum 72 having a first drum shell 74 and a second drum shell 76.

The drum shells 74 and 76 are connected so that the drum 72 rotates as a unit. The drum 72 is supported for rotation on supports (not shown) by a pair of roller rings 78. A chain and sprocket assembly (not shown) or the like is provided to rotate the drum 72.

The drum 72 has an entry end 80 and a discharge end 81. An exhaust duct 82 communicates with the entry end 80 of the drum 72 to draw gases through the drum 72. The exhaust duct 82 is connected to a conventional exhaust system for receiving and processing exhaust gases from the drum 72. An aggregate conveyor 83 is provided at the entry end 80 of the drum 72 to introduce material, typically virgin aggregate, into the drum 72.

An internal passageway extends through the drum 72 between the entry end 80 and the discharge end 81. The internal passageway through the drum 72 defines a drying zone 84, a combustion zone 86 and a mixing zone 88.

The drying zone 84 extends from entry end 80 of the drum 72 and communicates with the combustion zone 86. The mixing zone 88 communicates with the opposite end of the combustion zone 86 and extends to the discharge end 81 of the drum 72.

The drying zone 84 has a first drying section 90 and a second drying section 92. Typically, the first drying section 90 is shorter in length than the second drying section 92. It should be appreciated that an intermediate portion of the second drying section 92 is omitted in FIG. 2.

Further, the first drying section 90 is typically greater in diameter than the second drying section 92. The volume of exhaust gas increases as it nears the exhaust duct 82 due to moisture vapor and the products of combustion. The larger diameter of the first drying section 90 helps keep the velocity of the exhaust gases from increasing as they near the exhaust duct 82.

In order to accommodate the change in the diameter of the drum 72, a drying transition area 94 is located between the first and second drying sections 90 and 92. A plurality of spiral flights protrude from the interior wall of the drum 72 in the drying transition area 94 to lift the virgin aggregate upward out of the first drying section 90 and into the second drying section 92. One of the spiral flights, designated by reference numeral 98, is shown diagrammatically in FIG. 2 and is generally representative of the spiral flights in the drying transition area 94.

It should be appreciated that the spiral flights 98 are spaced over the entire interior wall of the drum 72 in the drying transition area 94. In the case of an eight-foot diameter drum 72, for example, fourteen spiral flights 98 may be equally spaced over the interior wall of the drum in the drying transition area 94.

The drying zone 84 may be provided with any suitable arrangement of flights for veiling, lifting and moving aggregate material. Typically, a set of spiral flights is located at the entry end 80 of the drum 72 to lift material into the drum 72. One of these spiral flights is designated by reference numeral 100 and is generally representative of spiral flights in the drying zone 84. In a typical arrangement for a drum which is about eight feet in diameter, fourteen equally spaced spiral flights 100 protrude from the interior wall of the drum 72.

Flights designated by reference numeral 102 are generally representative of veiling flights in the drum 72. Veiling flights 102 are located in the drying zone 84 and in the combustion zone 86. The preferred veiling flight 102 is a "pumpkin-tooth" flight, which has a set of flat-toothed veiling members for cascading material as the drum 72 is rotated. One of the sets of flat-toothed members is designated by reference numeral 104 and is generally representative of the flat-toothed veiling members of the veiling flights 102.

In the combustion zone 86, the first drum shell 74 and the second drum shell 76 have increased diameters. A tubular combustion housing 106 which defines a combustion chamber 108 is mounted within the combustion zone 86 of the drum 72. A burner assembly 110 extends into the drum 72 to direct a burner flame 112 into the combustion chamber 108.

The combustion housing 106 is substantially concentric with the first and second drum shells 74 and 76. In the combustion zone 86, the second drum shell 76 circumscribes the entire length of the combustion housing 106 and an end portion of the first drum shell 74 to define an outer annulus 114. In turn, an end portion of the first drum shell 74 circumscribes an end portion of the combustion housing 106 to define an inner annulus 116 therebetween.

Further, the interior wall of the second drum shell 76 and the combustion housing 106 define a combined heating/mixing zone 118 therebetween. The heating/mixing zone 118 communicates with both the outer annulus 114 and the inner annulus 116.

A first end 120 of the combustion housing 106 is open to expose the burner flame 112 to the drying zone 84. At the opposite second end 122 of the combustion housing 106, a tubular frustoconical transition housing 124 is provided to keep aggregate and recycle material from entering the burner assembly 110.

A diverter pan 126 is located between the combustion housing 106 and the transition housing 124 at the second end 122 of the combustion housing 106. The diverter pan 126 is spaced a distance from the combustion housing 106 such that the combustion chamber 108 communicates with the heating/mixing zone 118 at the second end 122 of the combustion housing 106.

The diverter pan 126 is shaped like a pie pan and comprises a diverter base 128 and a diverter wall 130. The diverter base 128 extends around the transition housing 124 and the diverter wall 130 protrudes angularly outward from the diverter base 128.

The outside diameter of the diverter pan 126 is less than the inner diameter of the second drum shell 76 in the combustion zone 86. Thus there is provided a transfer annulus 132 between the interior wall of the second drum shell 76 and the diverter pan 126.

A mixing transition area 134 connects the combustion zone 86 and the mixing zone 88. A plurality of spiral flights, such as the one shown and designated by reference numeral 135, protrude from the interior wall of the drum 72 in the mixing transition area 134 to lift material from the heating/mixing zone 118 into the mixing zone 88.

An liquid asphalt injection assembly 136 is provided in the mixing zone 88 to introduce liquid asphalt. In addition, a filler tube 138 extends into the mixing zone 88 in order to introduce mineral filler, dust or fine particulate materials into the asphalt mix.

A plurality of mixing flights extend inward from the interior drum wall of the mixing zone 88. One of the mixing flights is designated by reference numeral 140 and is generally representative of the mixing flights in the mixing zone 88.

In a typical arrangement for a drum 72 having a diameter of approximately eight feet, there may be three rows of mixing flights 140. Each row of mixing flights 140 typically comprises twelve mixing flights 140 equally spaced around the inner periphery of the drum wall in the mixing zone 88.

Figure 3:
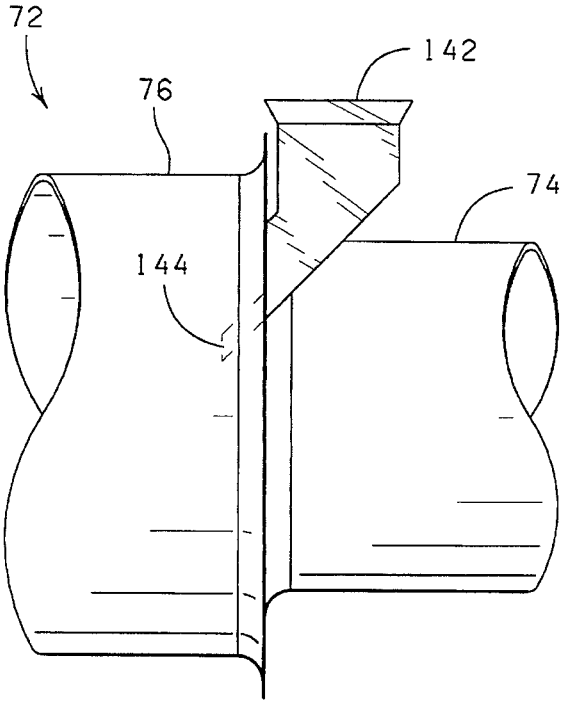
FIG. 3 is a partly diagrammatical side view of the entry area into the combustion zone of the drum mixer of FIG. 2.
Figure 4:
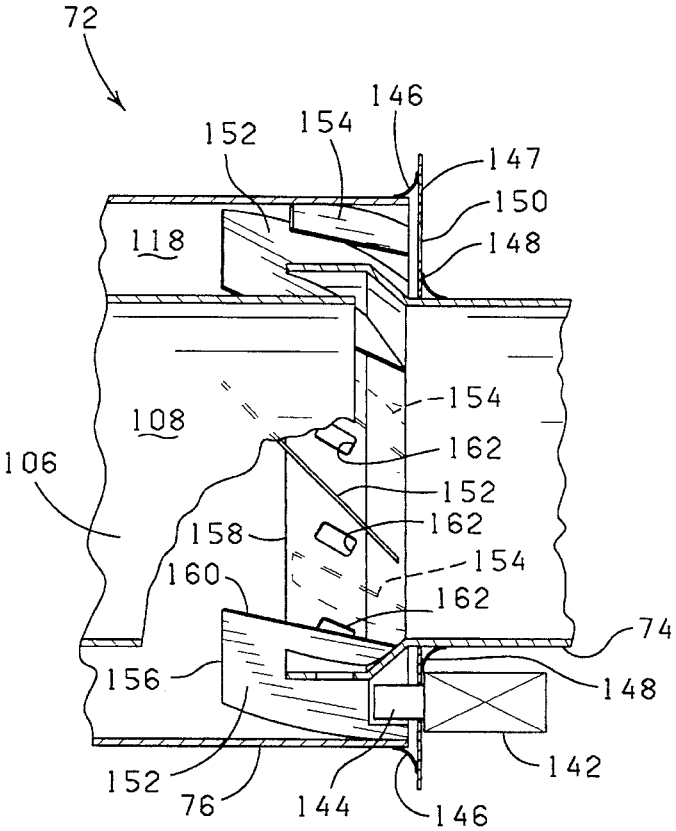
FIG. 4 is a partly diagrammatical, partly sectional top view of the entry area into the combustion zone of the drum mixer of FIG. 2.

Turning to FIGS. 3 and 4, shown therein is a portion of the drum 72 at the intersection of the drying zone 84 and the combustion zone 86. A recycle feed hopper 142 is mounted just outside the first drum shell 74 and has a recycle feed chute 144 extending into outer annulus 114 between the first drum shell 74 and the second drum shell 76. It should be appreciated that the recycle feed hopper 142 is supported in any suitable manner to remain stationary as the drum 72 is rotated.

An outer seal 146 is secured to the second drum shell 76 and extends outward toward the recycle breeching 147. An inner seal 148 is mounted to the recycle breeching 147 and extends inward to the first drum shell 74. As best seen in FIG. 4, the recycle breeching 147 has an annular recycle opening 150 which receives the recycle feed chute 144. The inner and outer seals 146 and 148 typically comprise an elastomeric, fibrous or metallic material and cooperate with the recycle breeching 147 to close the annular recycle opening 150 between the first drum shell 74 and the second drum shell 76 except for the annular recycle opening 150.

With reference to FIG. 4, shown therein is the transition and connection between the first drum shell 74 and the second drum shell 76. It should be appreciated that a portion of the combustion housing 106 is cut away for purposes of illustration.

A plurality of long spiral flights 152 and short spiral flights 154 extend from the interior wall of the second drum shell 76 in an alternating arrangement. The long spiral flights 152 and the short spiral flights 154 are shaped to travel past the recycle feed chute 144 with clearance as the drum 72 is rotated.

The long spiral flights 152 connect the two drum shells 74 and 76 together by being secured to the interior wall of the second drum shell 74 and to the first drum shell 76 in the combustion zone 86. One end 156 of each long spiral flight 152 protrudes beyond the end 158 of the first drum shell 74. Moreover, an inward portion 160 of each long spiral flight 152 extends into the interior of the first drum shell 74.

In contrast, the short spiral flights 154 protrude neither past the end 156 of the first drum shell 74 nor into the interior of the first drum shell 74. In fact, spacing is provided between the short spiral flights 154 and the outer wall of the first drum shell 74.

Between each pair of adjacent long spiral flights 152 and short spiral flights 154, a drum shell aperture 162 extends through the second drum shell 76. The drum shell apertures 162 provide a passageway for movement of material between the outer annulus 114 and the interior of the first drum shell 74.

Figure 5:
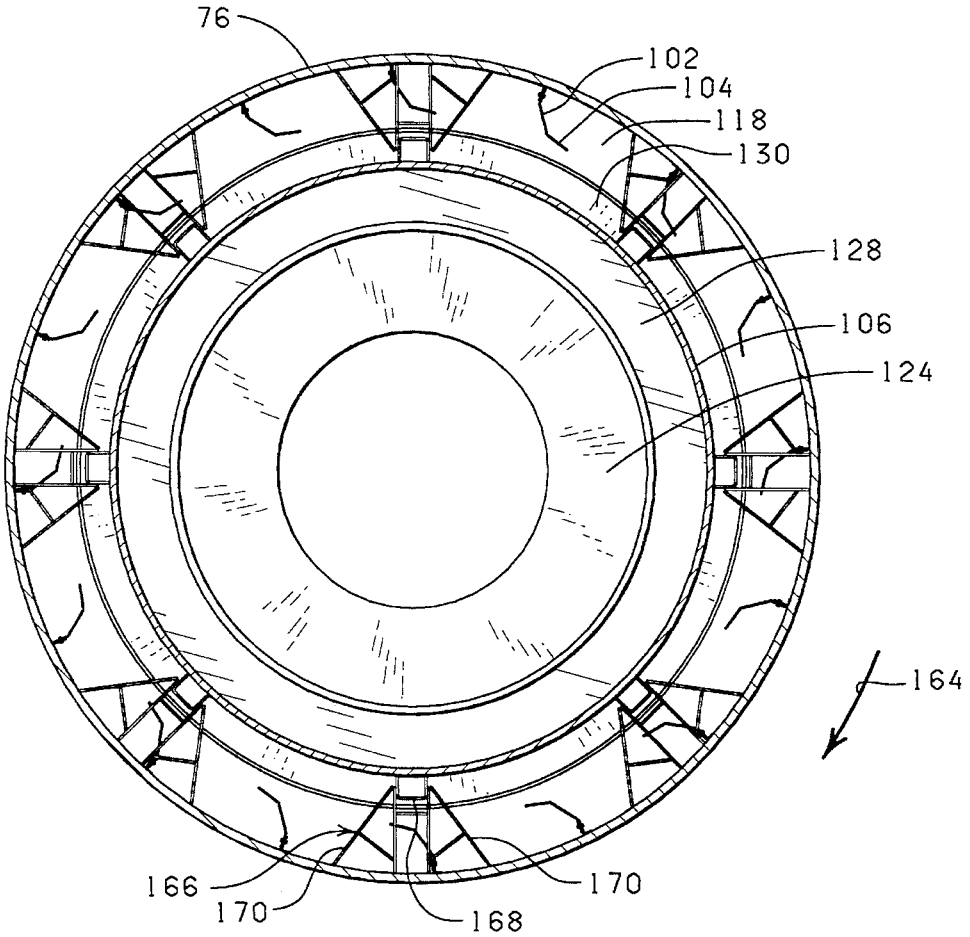
FIG. 5 is sectional view of the drum mixer of FIG. 2 taken along the lines 5—5 of FIG. 2.

Turning to FIG. 5, shown therein is a partly diagrammatical, sectional view of the combustion zone 86. For clarity of illustration, the burner assembly 110 is not shown in FIG. 5.

As mentioned hereinabove, veiling flights 102 extend from the interior drum wall into the heating/mixing zone 118. Each veiling flight 102 is mounted to the interior drum wall with the flat-toothed veiling members 104 located in the heating/mixing zone 118. Thus, the veiling flights 102 and flat-toothed veiling members 104 cause material in the heating/mixing zone 118 to cascade, or "veil" as the drum 72 is rotated in the direction indicated by rotational arrow 164.

The combustion housing 106 is secured to the interior drum wall by a plurality of bracket assemblies. One of the bracket assemblies is designated by reference numeral 166 and is generally representative of the bracket assemblies. Each bracket assembly 166 comprises a mounting bracket 168 supported on each side by a pair of bracing brackets 170.

An end portion of the transition housing 124 is circumscribed by the second end 122 of the combustion housing 106. The base 128 of the diverter pan 126 extends between the transition housing 124 and the combustion housing 106 at the Second end 122 of the combustion housing 106. The diverter wall 130 of the diverter pan 126 extends angularly beyond the combustion housing 106 a distance into the heating/mixing zone 118.

Figure 6:
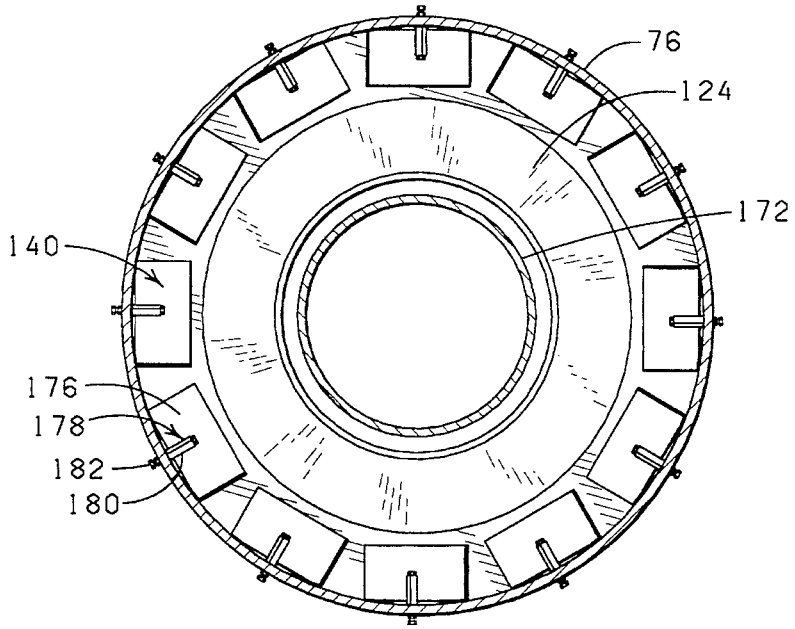
FIG. 6 is a sectional view of the drum mixer of FIG. 2 taken along the lines 6—6 of FIG. 2.

With reference to FIG. 6, shown therein is a partly diagrammatical, sectional view of the mixing zone 88. Although the burner assembly 110 is not included for purposes of clarity, the outer tube 172 of the burner assembly 110 is shown.

The transition housing 124 circumscribes an end portion of the outer tube 172 of the burner assembly 110. Material is mixed in the mixing area between the inner wall of the second drum shell 76 and the outer tube 172 of the burner assembly 110.

The mixing flights 140 protrude from the interior drum wall into the mixing area between the second drum shell 76 and the outer tube 172 of the burner assembly 110. Each mixing flight 140 is basically a mixing plate 176 secured to a bolt assembly 178 which extends through the drum wall to the exterior of the drum 72. Each bolt assembly 178 includes a bolt 180, lock nut, lock washer and flat washer assembly 182 outside the drum 72.

With this construction, the orientation of the mixing flights 140 may be changed from the outside of the drum 72 by loosening the lock nut, rotating the bolt 180 to a selected position, and tightening the lock nut. The ability to change the orientation of the mixing flights 140 is advantageous in order to adjust the length of time that material is retained in the mixing zone 88 before being discharged from the discharge end 81 of the drum 72.

Operation

The operation of the drum mixer 70 is best understood by reference to FIG. 2. Before beginning production, the burner assembly 110 is started up and the drum 72 is preheated to a desired operating temperature.

Virgin aggregate is introduced into the drying zone 84 at the entry end 80 of the drum 72, as indicated by direction arrow 184. As the drum 72 is rotated, the virgin aggregate is cascaded by the veiling flights 102 in the drying zone 84. The hot gas stream from the burner flame 112 dries and heats the virgin aggregate as the virgin aggregate is urged toward the combustion zone 86.

Upon reaching the combustion zone 86, a portion of the hot, dry aggregate enters the combustion chamber 108 (direction arrow 186) and another portion of the aggregate enters the heating/mixing zone 118 through the inner annulus 116 at the first end 120 of the combustion housing 106 (direction arrow 188).

As indicated by arrowhead 190, a first portion of the aggregate in the inner annulus 116 is urged directly into the heating/mixing zone 118. However, a second portion of the aggregate in the inner annulus 116 passes through the drum shell apertures 162 into the outer annulus 114 before reaching the heating/mixing zone 118 (arrowhead 192).

Meanwhile, recycle asphalt pavement or any other suitable recycle material is introduced by way of the recycle feed hopper 142 into the heating/mixing zone 118 through the outer annulus 114 (arrowhead 194). As the drum 72 rotates, a portion of the recycle material passes through the drum shell apertures 162 into the inner annulus 116 before reaching the heating/mixing zone 118 (arrowhead 196).

Thus, a portion of the aggregate and a portion of the recycle material are both urged into the inner annulus 116 and the outer annulus 114 before traveling on to the heading/mixing zone 118. Accordingly, a preliminary phase of mixing recycle material with hot aggregate takes place in the inner annulus 116 and outer annulus 114.

While the preliminary mixing takes place, the first portion of aggregate travels through the combustion chamber 108 and is urged by the diverter pan 126 into the heating mixing zone 118 at the second end 122 of the combustion housing (direction arrow 198). Thus, hot and dry aggregate enters the heating/mixing zone 118 at the first end 120 of the combustion housing 106 and even hotter and drier aggregate enters the heating/mixing zone 118 at the second end 122 of the combustion housing 106.

The aggregate and recycle material are cascaded by the veiling flights 102 in the heating/mixing zone 118 to mix and heat all the material. Eventually, the aggregate/recycle material is urged past the diverter pan 126 and into the mixing transition area 134, where the spiral flights 135 lift the aggregate/recycle material into the mixing zone 88.

Liquid asphalt is introduced into the mixing zone 88 of the drum 72 by the liquid asphalt injection assembly 136. As the drum 72 is rotated, the mixing flights 140 thoroughly coat the aggregate/recycle material with the liquid asphalt to produce a hot mix asphaltic composition, which is discharged at the discharge end 81 of the drum 72.

Changes may be made in the combinations, operations and arrangements of the various parts and elements described herein without departing from the spirit and scope of the invention as defined in the following claims.

What is claimed is:

1. An apparatus for heating and mixing asphalt-aggregate compositions, the apparatus comprising:

a rotatable drum having a first drum section and a second drum section, the first drum section defining a drying zone, the second drum section defining a mixing zone, and an end portion of the second drum section circumscribing an end portion of the first drum section to define a combustion zone between the drying zone and the mixing zone;

a combustion housing mounted within the combustion zone of the drum, the combustion housing having an end portion circumscribed by the end portion of the first drum section to define an inner annulus therebetween, the combustion housing and the second drum section defining a heating-mixing zone therebetween, the combustion housing defining a combustion chamber having a first end communicating with the drying zone and a second end communicating with the heating-mixing zone;

a burner assembly producing a flame having a stream of hot gases flowing from the combustion chamber toward the drying zone of said drum;

means for introducing aggregate into the drying zone of said drum;

means for urging a first portion of aggregate from the drying zone into the heating-mixing zone through the inner annulus and means for urging a second portion of aggregate from the drying zone into the heating-mixing zone through the combustion chamber;

means for introducing liquid asphalt into the mixing zone of said drum to form an asphaltic composition from aggregate and liquid asphalt in the mixing zone if said drum; and means for removing the asphaltic composition from the mixing zone of said drum; and a diverting plate secured within said drum between the second end of the combustion chamber and the mixing zone, said diverting plate being sized and shaped to direct the second portion of the aggregate from the combustion chamber into the heating-mixing zone before the aggregate is urged around said diverting plate to the mixing zone.

2. The apparatus of claim 1 wherein said diverting plate comprises:

an outwardly angled sidewall for directing the second portion of aggregate into the heating-mixing zone before being urged around said diverting plate to the mixing zone.

3. An apparatus for heating and mixing asphalt-aggregate compositions, the apparatus comprising:

a rotatable drum having a first drum section and a second drum section, the first drum section defining a drying zone, the second drum section defining a mixing zone, and an end portion of the second drum section circumscribing an end portion of the first drum section to define a combustion zone between the drying zone and the mixing zone;

a combustion housing mounted within the combustion zone of the drum, the combustion housing having an end portion circumscribed by the end portion of the first drum section to define an inner annulus therebetween, the combustion housing and the second drum section defining a heating-mixing zone therebetween, the combustion housing defining a combustion chamber having a first end communicating with the drying zone and a second end communicating with the heating-mixing zone;

a burner assembly producing a flame having a stream of hot gases flowing from the combustion chamber toward the drying zone of said drum;

means for introducing aggregate into the drying zone of said drum;

a plurality of mixing flights protruding into the mixing zone from said drum;

means for introducing liquid asphalt into the mixing zone of said drum to form an asphaltic composition from aggregate and liquid asphalt in the mixing zone of said drum;

means for urging a first portion of aggregate from the drying zone into the heating-mixing zone through the inner annulus and means for urging a second portion of aggregate into the heating-mixing zone through the combustion chamber;

means for removing the asphaltic composition from the mixing zone of said drum; and wherein the orientation of each one of said mixing flights is adjustable from the outside of said drum.

4. An apparatus for heating and mixing aggregate material, the apparatus comprising:

a rotatable drum having a first drum section and a second drum section, the first drum section defining a drying zone, the second drum section defining a mixing zone, and an end portion of the second drum section circumscribing an end portion of the first drum section to define a combustion zone between the drying zone and the mixing zone;

a combustion housing mounted within the combustion zone of the drum, the combustion housing having an end portion circumscribed by the end portion of the first drum section to define an inner annulus therebetween, the combustion housing and the second drum section defining a heating-mixing zone therebetween, the combustion housing defining a combustion chamber having a first end communicating with the drying zone and a second end communicating with the heating-mixing zone;

a burner assembly producing a flame having a stream of hot gases flowing from the combustion chamber toward the drying zone of said drum;

means for urging a first portion of aggregate material from the drying zone into the heating-mixing zone through the inner annulus; and means for urging a second portion of aggregate material from the drying zone through the combustion chamber and into the heating-mixing zone.

5. The apparatus of claim 4 further comprising:

means for introducing aggregate into the drying zone of said drum.

6. The apparatus of claim 4 further comprising:

means for introducing liquid asphalt into the mixing zone of said drum to form an asphaltic composition from aggregate and liquid asphalt in the mixing zone of said drum; and means for removing the asphaltic composition from the mixing zone of said drum.

7. The apparatus of claim 4 further comprising:

means for introducing recycle material into the heating-mixing zone.

8. The apparatus of claim 4 wherein the combustion zone of said drum has a diameter approximately equal to the diameter of the drying zone of said drum.

9. The apparatus of claim 4 wherein the combustion zone of said drum has a diameter approximately equal to the diameter of the mixing zone of said drum.

10. The apparatus of claim 4 wherein said drum has a transition area between the combustion zone and the mixing zone of said drum.

11. The apparatus of claim 10 further comprising:

a transition housing circumscribing said burner assembly in the transition area to keep aggregate from entering the burner assembly.

12. The apparatus of claim 10 further comprising:

a plurality of lifting flights mounted to the interior wall of said drum in the transition area to urge aggregate material out of the heating-mixing zone and into the mixing zone.

13. The apparatus of claim 4 further comprising:

a plurality of mixing flights protruding into the mixing zone from said drum.

14. The apparatus of claim 13 wherein the orientation of each one of said mixing flights is adjustable from the outside of said drum.

* * * * *